US009747821B2

(12) United States Patent
Gastelum

(10) Patent No.: US 9,747,821 B2
(45) Date of Patent: Aug. 29, 2017

(54) THREE-DIMENSIONAL ARTWORK AND METHOD FOR PRODUCING THREE-DIMENSIONAL ARTWORK

(71) Applicant: Frank Gastelum, Indian Land, NC (US)

(72) Inventor: Frank Gastelum, Indian Land, NC (US)

( * ) Notice: Subject to any disclaimer, the term of this patent is extended or adjusted under 35 U.S.C. 154(b) by 0 days.

(21) Appl. No.: 15/060,952

(22) Filed: Mar. 4, 2016

(65) Prior Publication Data

US 2016/0307478 A1 Oct. 20, 2016

Related U.S. Application Data

(60) Provisional application No. 62/149,736, filed on Apr. 20, 2015.

(51) Int. Cl.

| | |
|---|---|
| ***G09F 13/22*** | (2006.01) |
| ***G09F 9/00*** | (2006.01) |
| ***A47G 1/12*** | (2006.01) |
| ***B44C 3/02*** | (2006.01) |
| ***B44F 7/00*** | (2006.01) |

(52) U.S. Cl.

CPC ..... *G09F 13/22* (2013.01); *A47G 1/12* (2013.01); *B44C 3/025* (2013.01); *B44F 7/00* (2013.01); *G09F 9/00* (2013.01); *G09F 2013/222* (2013.01)

(58) Field of Classification Search

CPC ..... A47G 1/12

See application file for complete search history.

(56) References Cited

U.S. PATENT DOCUMENTS

| | | | | |
|---|---|---|---|---|
| 3,517,937 | A | 6/1970 | Glass et al. | |
| 3,553,062 | A * | 1/1971 | Berlin | B44C 3/025 156/59 |
| 3,897,645 | A * | 8/1975 | Scheyer | B44F 7/00 40/800 |
| 4,161,831 | A * | 7/1979 | Restle | A47G 1/0616 40/800 |
| 4,286,399 | A * | 9/1981 | Funahashi | B42D 1/007 40/124.02 |
| 4,957,291 | A | 9/1990 | Miffitt et al. | |
| 5,157,852 | A * | 10/1992 | Patrou | G09F 1/08 40/124.16 |
| 5,783,005 | A * | 7/1998 | Handler | A47G 1/0616 156/264 |
| 7,013,591 | B2 * | 3/2006 | Lee | G09F 13/00 40/124.191 |
| 8,602,833 | B2 | 12/2013 | Binder | |

(Continued)

*Primary Examiner* — Gary C Hoge

(74) *Attorney, Agent, or Firm* — Global Intellectual Property Agency, LLC; Daniel Boudwin

(57) ABSTRACT

A three-dimensional artwork device that provides a three-dimensional appearance for providing visual interest. The three-dimensional artwork includes a base layer having an upper surface having artwork thereon. One or more spacers are positioned on the base layer, and one or more art layers are positioned on the spacers. The art layers overhang the edges of the spacers so that the spacers are not visible to an observer. Multiple spacers and art layers can be stacked to provide additional depth. A plurality of LEDs is positioned on the base layer, and are preferably positioned adjacent to the spacers so that the LEDs are not visible by an observer.

12 Claims, 3 Drawing Sheets

(56) References Cited

U.S. PATENT DOCUMENTS

| | | | | |
|---|---|---|---|---|
| 8,739,438 | B1 * | 6/2014 | Deckerd | B42D 15/022 40/124.02 |
| 8,876,585 | B1 | 11/2014 | Ghaly | |
| 2003/0079393 | A1 * | 5/2003 | Goodwin | A47G 1/0616 40/717 |
| 2009/0158633 | A1 * | 6/2009 | Mamiya | B44C 5/02 40/800 |

* cited by examiner

THREE-DIMENSIONAL ARTWORK AND METHOD FOR PRODUCING THREE-DIMENSIONAL ARTWORK

CROSS REFERENCE TO RELATED APPLICATION

This application claims the benefit of U.S. Provisional Application No. 62/149,736 filed on Apr. 20, 2015. The above identified patent application is herein incorporated by reference in its entirety to provide continuity of disclosure.

BACKGROUND OF THE INVENTION

Field of the Invention

The present invention relates to artwork. More specifically, the present invention provides three-dimensional artwork device and a method for producing the same.

Artwork is commonly displayed in homes and offices as a way to improve the aesthetic appeal of the room and as a way to create a specific type of environment. Paintings and photographs are commonly framed and hung on the walls in order to provide visual interest in a room and are used to fill empty space on a wall. However, paintings and photographs are generally two-dimensional and are printed or painted on flat paper or canvas. As a result, many pictures or paintings provide little visual interest and can be dull and uninspiring.

Further, paintings are often hung along with specific lighting fixtures intended to illuminate the painting so as to draw attention to the painting and so as to ensure that the painting is displayed in proper lighting. However, installing a light fixture solely to illuminate a painting can be time consuming and inconvenient. Many people may be unable to provide the required lighting, resulting in the painting being difficult to view. Thus, an improved three-dimensional artwork and method for creating the same is desired.

SUMMARY OF THE INVENTION

In view of the foregoing disadvantages inherent in the known types of artwork now present in the prior art, the present invention provides a new artwork device wherein the same can be utilized for providing convenience for the user when providing three-dimensional artwork that includes adjustable illumination for providing visual interest.

The present invention provides a three-dimensional artwork device comprising a base layer on which one or more spacers are positioned. One or more art layers are disposed on the spacers, wherein the spacers serve to elevate the art layers above the surface of the base layer. This helps to create a three-dimensional effect, wherein elements of the drawing that are intended to be nearest the user are positioned on the elevated art layers. Further, a plurality of LEDs are positioned on the base layer so as to provide illumination to the base layer, adding visual interest and helping to light the artwork for ease of viewing in low light.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
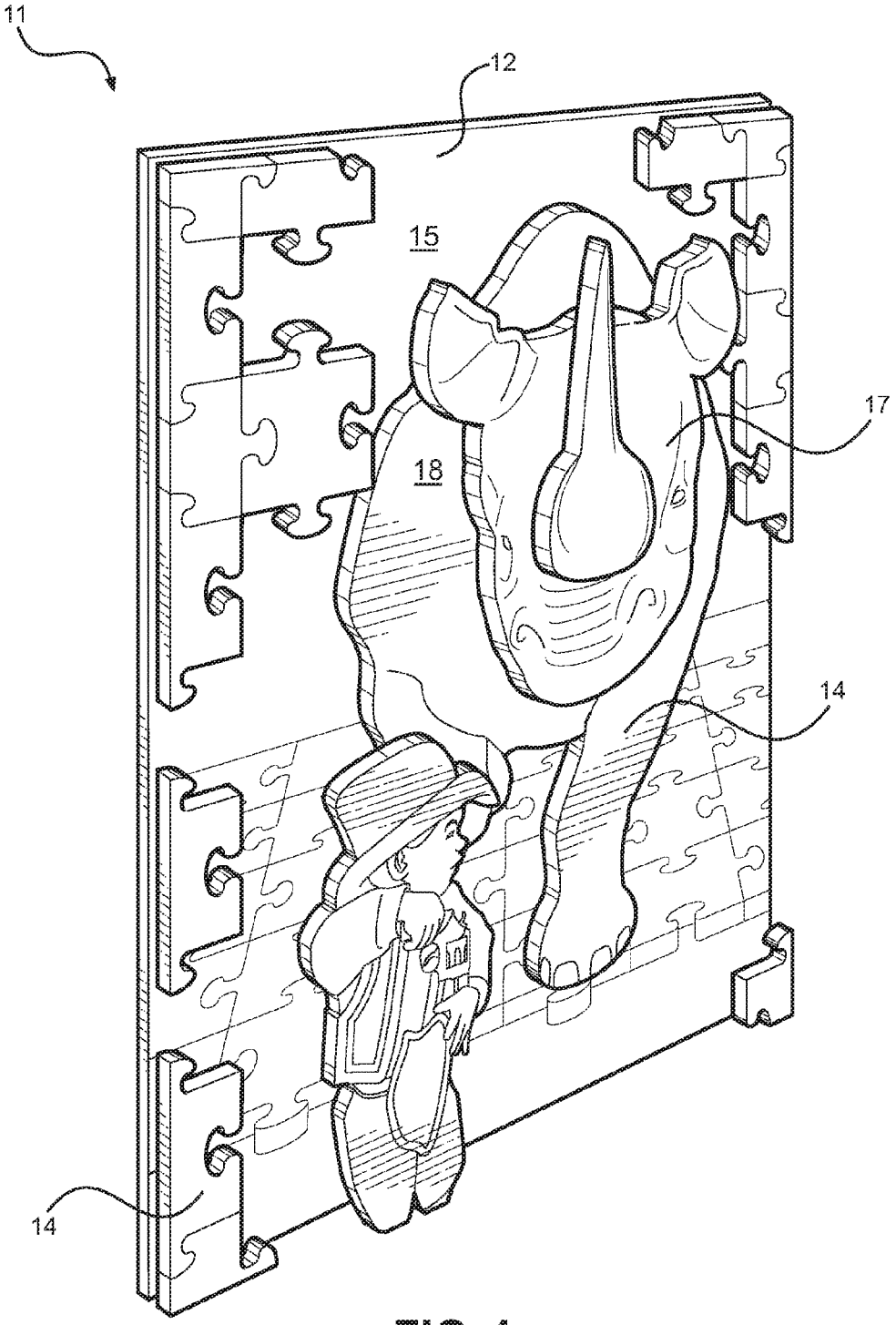
FIG. 1 shows a perspective view of the three-dimensional artwork device.

Reference is made herein to the attached drawings. Like reference numerals are used throughout the drawings to depict like or similar elements of the three-dimensional artwork device. For the purposes of presenting a brief and clear description of the present invention, the preferred embodiment will be discussed as used for providing a unique and visually interesting artwork that has a three-dimensional appearance. The figures are intended for representative purposes only and should not be considered to be limiting in any respect.

Referring now to FIG. 1, there is shown a perspective view of the three-dimensional artwork device. The three-dimensional artwork device 11 comprises a base layer 12 having a decorative upper surface 15. The surface 15 preferably comprises a painting or other artwork thereon. The base layer 12 is preferably a rectangular panel that is composed of canvas or paperboard, among other materials. Preferably, the base layer 12 is composed of a material commonly used for painting, drawing, or the like. The base layer 12 is adapted to be hung on a wall or other vertical support surface, so that the three-dimensional artwork device 11 is displayed similarly to the manner in which a conventional painting is displayed.

One or more art layers 14 are attached to the base layer 12 via spacers that serve to elevate the art layers 14 above the surface 15 of the base layer 12. The spacers help to create a gap between the art layer 14 and base layer 12 to create a sense of depth. The art layers 14 include a decorative surface 18 having artwork or drawings thereon that correspond to the artwork or drawings on the base layer 12. Thus, the base layer 12, and one or more art layers 14 provide a single, integrated image, wherein some elements of the artwork are positioned closer towards the viewer by virtue of their positioning on the art layers 14. Preferably, a single image is drawn onto the surfaces of the base layer and one or more art layers, so that in combination the base layer and art layers form the full image. Multiple art layers 14 can be stacked on top of one another so as to create additional depth to the three-dimensional artwork 11. In the illustrated embodiment, a secondary art layer 17 is shown as being positioned on an art layer 14 and separated therefrom via a spacer.

Figure 2:
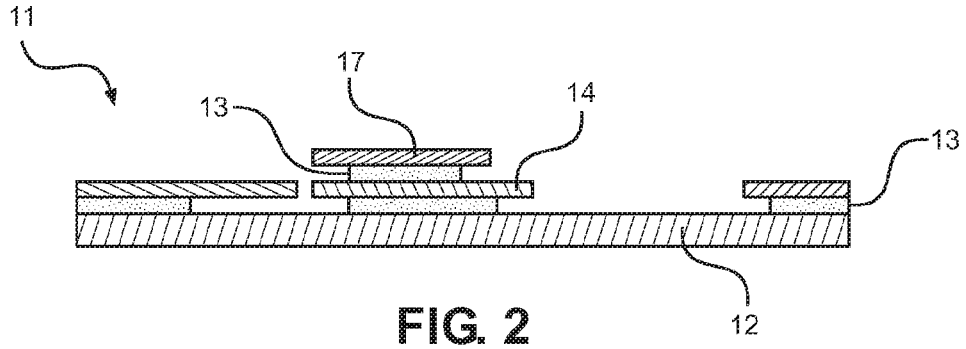
FIG. 2 shows a cross sectional view of the three-dimensional artwork device.

Referring now to FIG. 2, there is shown a cross sectional view of the three-dimensional artwork device. One or more spacers 13 are affixed to the surface of the base layer 12. The spacers 13 are adapted to separate the art layers 14 from the base layer 12 so as to create a sense of depth. An enhanced sense of depth is achieved by separating the art layers 14 from the base layers 12 by a space defined by the spacers 13. The spacers 13 are preferably composed of a foam material or other similar material. The spacers 13 are affixed via adhesives or sealants among other fastening materials. An art layer 14 is then affixed onto the upper surface of the spacer 13 so that the art layer 14 is substantially parallel to the base layer 12. The art layers 14 comprise a greater width than the spacers 13 so that the spacers 13 are not visible when the three-dimensional artwork device 11 is viewed by an observer. In this way, a peripheral portion of the art layers 14 extends beyond the spacers 13, creating an overhang. This allows the art layers 14 to appear to be floating or suspended above the base layer 12.

In some embodiments, additional spacers 13 and secondary art layers 17 are disposed on top of the art layer 14. In this way, various art layers having decorative surfaces are disposed at different elevations, creating depth and a three-dimensional appearance. Preferably, elements of the painting or picture that are intended to be closest to the viewer are disposed on the outermost art layers 14, 17 and elements of the painting or picture that are intended to be farther from the viewer are disposed on the base layer 12.

For example, the artwork showing a rhinoceros of FIG. 1 shows the body of the rhinoceros as a first art layer 14. The head of the rhinoceros is then disposed on a secondary art layer 17 so that the head appears to be extending closer toward the viewer. Finally, the horn of the rhinoceros is positioned on an additional art layer so that it is closest to the user. This arrangement helps to create a sense that the rhinoceros is moving out of the artwork and towards the user.

Figure 3:
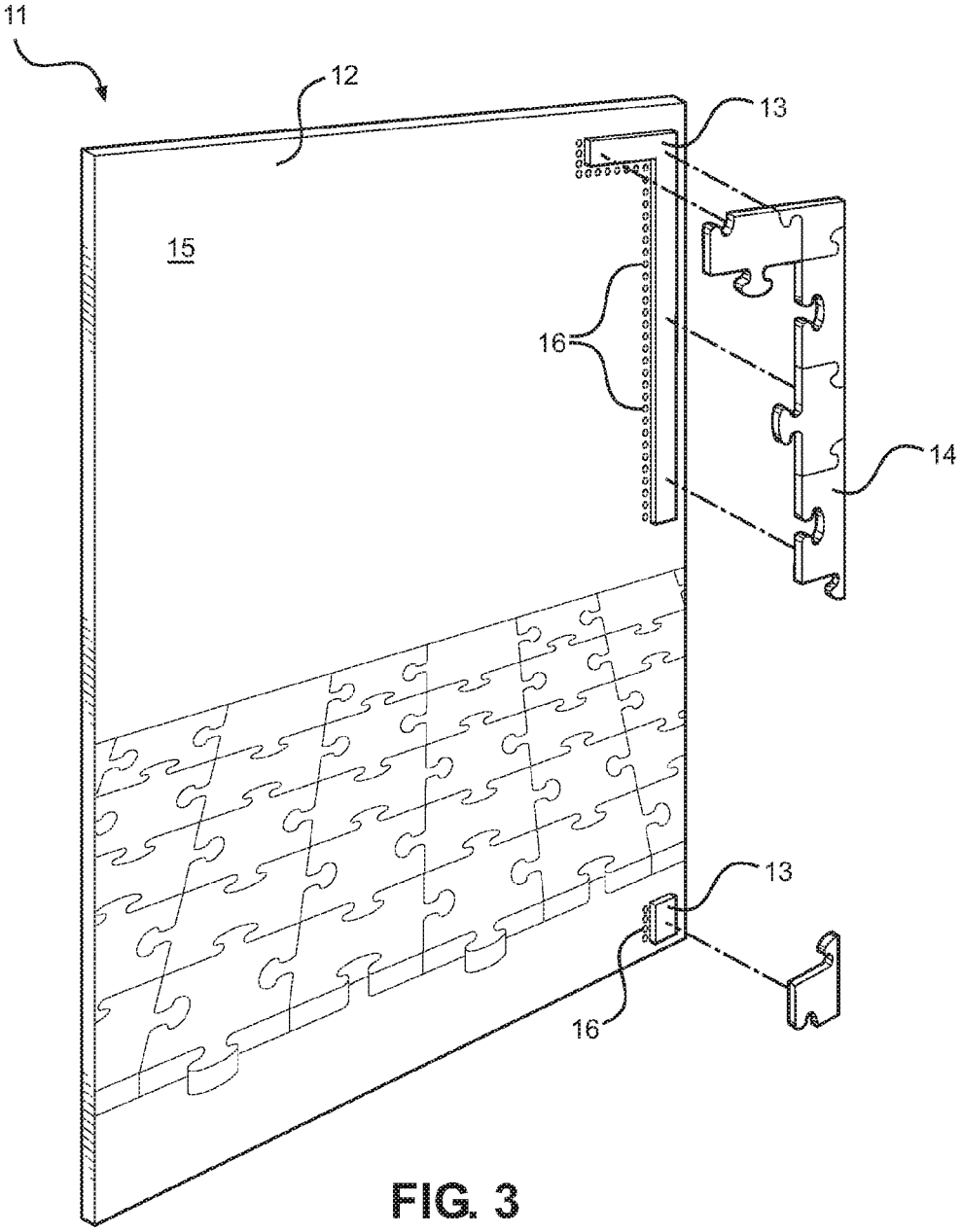
FIG. 3 shows an exploded view of the layers of the three-dimensional artwork device.

Referring now to FIG. 3, there is shown an exploded view of the layers of the three-dimensional artwork device. The three-dimensional artwork device 11 further comprises a plurality of LEDs 16. The LEDs 16 are preferably electrically connected to one another and are powered by a power source. The LEDs 16 are disposed on the base layer 12 adjacent to the spacers 13 so as to provide illumination on the base layer 12 and beneath the art layers 14. The art layers 14 overhang the edges of the spacers 13 so the LEDs 16 are hidden and are not visible when the three-dimensional artwork is viewed by an observer. In this way, illumination is provided from the base layer 12, wherein the LEDs 16 themselves are not visible to the viewer of the artwork device 11.

Figure 4:
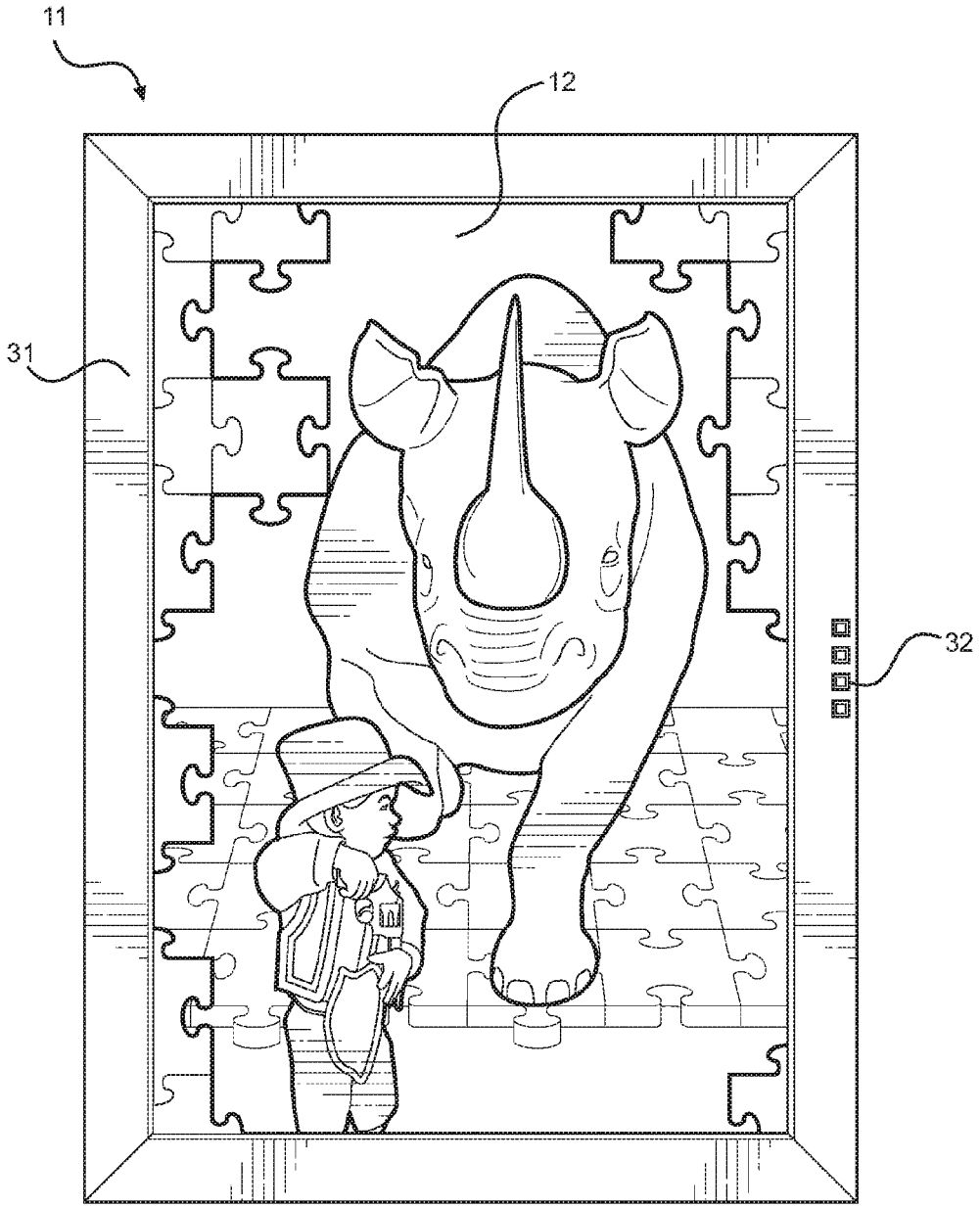
FIG. 4 shows a frontal view of the three-dimensional artwork device having a frame.

Referring now to FIG. 4, there is shown a frontal view of the three-dimensional artwork device having a frame. In some embodiments, the three-dimensional artwork device 11 comprises a frame 31 disposed around the base layer 12. The frame 31 includes a control unit 18 that is electrically and operably connected to the LEDs. The control unit 18 includes one or more switches 32 thereon that allow the user to control the color of the LEDs. Thus, the user can operate the switches 32 in order to cause the LEDs to produce a different color of light. This allows the user to change the appearance of the artwork simply by changing the color of the LED lights. The control unit 18 and a power source 33 are preferably stored within a frame 31 that is disposed on the periphery of the base layer 12.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A three-dimensional artwork device, comprising:

a base layer having an upper surface having a decorative appearance;

one or more spacers affixed to the upper surface of the base layer;

one or more art layers affixed to the one or more spacers so that the one or more art layers are elevated above the base layer;

a plurality of LEDs disposed on the base layer;

wherein an edge of the one or more art layers extends over the plurality of LEDs;

wherein the plurality of LEDs are disposed on the base layer along a perimeter edge of the one or more spacers.

2. The three-dimensional artwork device of claim 1, wherein the one or more spacers are composed of foam.

3. The three-dimensional artwork device of claim 1, wherein the one or more art layers have a greater width than the one or more spacers so that the one or more art layers overhang the edges of the one or more spacers.

4. The three-dimensional artwork device of claim 1, further comprising a frame disposed on the periphery of the base layer.

5. The three-dimensional artwork device of claim 4, wherein the frame comprises a control unit operably connected to the plurality of LEDs, wherein the control unit is adapted to control operation of the plurality of LEDs.

6. The three-dimensional artwork device of claim 5, wherein the control unit comprises one or more switches.

7. The three-dimensional artwork device of claim 1, wherein the one or more spacers are adhesively affixed to the base layer.

8. The three-dimensional artwork device of claim 1, wherein the one or more art layers comprise a decorative appearance.

9. The three-dimensional artwork device of claim 1, wherein the one or more art layers comprise a decorative appearance corresponding to the decorative upper surface of the base layer.

10. A method for producing three-dimensional artwork, comprising the steps of:

providing a base layer having a decorative image thereon;

affixing one or more spacers on an upper surface of the base layer;

affixing one or more art layers on the spacers, wherein the one or more art layers comprise a decorative appearance;

positioning a plurality of LEDs on the base layer, wherein the plurality of LEDs disposed along a perimeter edge of the one or more spacers.

11. The method for producing three-dimensional artwork of claim 10, wherein the step of affixing spacers on an upper surface of the base layer comprises the steps of:

applying an adhesive to the base layer, and positioning the one or more spacers on the adhesive.

12. The method for producing three-dimensional artwork of claim 10, further comprising the steps of:

affixing one or more secondary spacers on the one or more art layers;

affixing one or more secondary art layers to the one or more secondary spacers.

* * * * *